US010077937B2

(12) United States Patent
Millar et al.

(10) Patent No.: US 10,077,937 B2
(45) Date of Patent: Sep. 18, 2018

(54) METHOD TO PRODUCE LNG

(71) Applicants: 1304342 Alberta Ltd., Edmonton (CA); 1304338 Alberta Ltd., Edmonton (CA)

(72) Inventors: MacKenzie Millar, Edmonton (CA); Jose Lourenco, Edmonton (CA)

(73) Assignees: 1304338 Alberta Ltd., Edmondon (CA); 1304342 Alberta Ltd., Edmonton (CA)

( * ) Notice: Subject to any disclaimer, the term of this patent is extended or adjusted under 35 U.S.C. 154(b) by 73 days.

(21) Appl. No.: 14/784,931

(22) PCT Filed: Apr. 14, 2014

(86) PCT No.: PCT/CA2014/050347
§ 371 (c)(1),
(2) Date: Oct. 15, 2015

(87) PCT Pub. No.: WO2014/169384
PCT Pub. Date: Oct. 23, 2014

(65) Prior Publication Data

US 2016/0061519 A1 Mar. 3, 2016

(30) Foreign Application Priority Data

Apr. 15, 2013 (CA) ..... 2813260

(51) Int. Cl.
*F25J 1/00* (2006.01)
*F25J 3/02* (2006.01)
(Continued)

(52) U.S. Cl.
CPC ..... *F25J 1/0022* (2013.01); *F25J 1/02* (2013.01); *F25J 3/0209* (2013.01); *F25J 3/0233* (2013.01);
(Continued)

(58) Field of Classification Search
CPC ..... F25J 3/0209; F25J 3/0233; F25J 3/0238; F25J 3/067
See application file for complete search history.

(56) References Cited

U.S. PATENT DOCUMENTS 2,168,438 A 8/1939 Carrier
3,002,362 A 10/1961 Morrison
(Continued)

FOREIGN PATENT DOCUMENTS

CA 1048876 A 2/1979
CA 2 422 893 A1 2/2002
(Continued)

OTHER PUBLICATIONS

Hudson, H.M., et al., "Reducing Treating Requirements for Cryogenic NGL Recovery Plants," Proceedings of the 80th Annual Convention of the Gas Processors Association, Mar. 12, 2001, San Antonio, Texas, 15 pages.
(Continued)

*Primary Examiner* — Frantz Jules
*Assistant Examiner* — Brian King
(74) *Attorney, Agent, or Firm* — Ryan E. Dodge, Jr.

(57) ABSTRACT

A method to produce LNG at straddle plants. In contrast to known methods, there is provided a slipstream of a high pressure, pre-treated, pre-cooled natural gas stream to a straddle LNG plant section. The slipstream is further cooled, and processed in a high pressure column to a methane content of 85% or 85 plus by mole. The processed stream is further treated to remove carbon dioxide. The de-carbonated high pressure stream is further cooled in a heat exchanger by a counter-current vapor fraction of the expanded gas before entering an expander apparatus. The processed, treated and cooled gas is expanded into a separator. The produced LNG fraction is pumped to storage. A portion of the LNG fraction
(Continued)

is used as a reflux stream to the high pressure column. The cold vapor fraction from the separator flows through counter-current heat exchangers, giving up its coolth energy before being re-compressed into the high pressure transmission gas pipeline.

10 Claims, 4 Drawing Sheets

(51) Int. Cl.
*F25J 1/02* (2006.01)
*C10L 3/10* (2006.01)

(52) U.S. Cl.
CPC ..... *F25J 3/0238* (2013.01); *C10L 3/106* (2013.01); *F25J 2200/02* (2013.01); *F25J 2200/70* (2013.01); *F25J 2205/04* (2013.01); *F25J 2210/06* (2013.01); *F25J 2215/04* (2013.01); *F25J 2240/02* (2013.01); *F25J 2290/60* (2013.01)

(56) References Cited

U.S. PATENT DOCUMENTS 3,152,194 A 10/1964 Pohl et al.
3,184,926 A 5/1965 Blake
3,241,933 A 3/1966 Ploum et al.
3,280,575 A 10/1966 Drake
3,315,475 A 4/1967 Harmens
3,367,122 A 2/1968 Tutton
3,653,220 A 4/1972 Foster et al.
3,735,600 A 5/1973 Dowdell et al.
3,747,359 A 7/1973 Streich
3,754,405 A 8/1973 Rosen
3,792,590 A 2/1974 Lofredo et al.
3,846,993 A 11/1974 Bates
3,859,811 A 1/1975 Duncan
3,892,103 A 7/1975 Antonelli
3,919,853 A 11/1975 Rojey
3,962,881 A 6/1976 Muska
4,033,735 A 7/1977 Swenson
4,170,115 A 10/1979 Ooka et al.
4,279,130 A 7/1981 Finch et al.
4,418,530 A 12/1983 Bodrov et al.
4,424,680 A 1/1984 Rothchild
4,430,103 A 2/1984 Gray et al.
4,444,577 A 4/1984 Perez
4,617,039 A 10/1986 Buck
4,681,612 A 7/1987 O'Brien et al.
4,710,214 A 12/1987 Sharma et al.
4,751,151 A 6/1988 Healy et al.
4,869,740 A 9/1989 Campbell et al.
4,907,405 A 3/1990 Polizzotto
4,936,888 A 6/1990 DeLong
5,026,952 A 6/1991 Bauer
5,062,270 A 11/1991 Haut et al.
5,137,558 A 8/1992 Agrawal
5,295,350 A 3/1994 Child et al.
5,329,774 A 7/1994 Tanguay et al.
5,425,230 A 6/1995 Shpak
5,440,894 A 8/1995 Schaeffer et al.
5,560,212 A 10/1996 Hansen
5,678,411 A 10/1997 Matsumura et al.
5,685,170 A 11/1997 Sorensen
5,782,958 A 7/1998 Rojey et al.
5,799,505 A 9/1998 Bonaquist et al.
5,953,935 A 9/1999 Sorensen
5,983,663 A 11/1999 Sterner
6,089,022 A 7/2000 Zednik et al.
6,089,028 A 7/2000 Bowen et al.
6,131,407 A 10/2000 Wissolik
6,138,473 A 10/2000 Boyer-Vidal
6,182,469 B1 2/2001 Campbell et al.
6,266,968 B1 7/2001 Redlich
6,286,315 B1 9/2001 Staehle
6,378,330 B1 4/2002 Minta et al.
6,432,565 B1 8/2002 Haines
6,517,286 B1 2/2003 Latchem
6,526,777 B1 3/2003 Campbell et al.
6,581,409 B2 6/2003 Wilding et al.
6,606,860 B2 8/2003 McFarland
6,640,555 B2 11/2003 Cashin
6,662,589 B1 12/2003 Roberts et al.
6,694,774 B1 2/2004 Rashad et al.
6,739,140 B2 5/2004 Bishop et al.
6,751,985 B2 6/2004 Kimble et al.
6,889,523 B2 5/2005 Wilkenson et al.
6,932,121 B1 8/2005 Shivers, III
6,945,049 B2 9/2005 Madsen
7,051,553 B2 5/2006 Mak et al.
7,107,788 B2 9/2006 Patel et al.
7,155,917 B2 1/2007 Baudat
7,219,502 B2 5/2007 Nierenberg
7,257,966 B2 8/2007 Lee et al.
7,377,127 B2 5/2008 Mak
8,429,932 B2 5/2013 Lourenco et al.
8,640,494 B2 2/2014 Lourenco et al.
8,850,849 B2 10/2014 Martinez et al.
8,887,513 B2 11/2014 Kotzot et al.
2002/0170297 A1 11/2002 Quine et al.
2003/0008605 A1 1/2003 Hartford, Jr. et al.
2003/0019219 A1 1/2003 Viegas et al.
2003/0051875 A1 3/2003 Wilson
2003/0182947 A1 10/2003 Kimble et al.
2003/0196452 A1 10/2003 Wilding et al.
2004/0065085 A1 4/2004 Madsen
2005/0086974 A1 4/2005 Steinbach et al.
2005/0244277 A1 11/2005 Hurst, Jr. et al.
2006/0213222 A1 9/2006 Whitesell
2006/0213223 A1 9/2006 Wilding et al.
2006/0242970 A1 11/2006 Yang et al.
2007/0062216 A1 3/2007 Mak et al.
2007/0107465 A1 5/2007 Turner et al.
2008/0016910 A1 1/2008 Brostow et al.
2009/0113928 A1 5/2009 Vandor et al.
2009/0194460 A1* 8/2009 Klein Nagul Voort .. C10G 5/06 208/187
2009/0194461 A1* 8/2009 Bras ..... C10L 3/10 208/368
2009/0249829 A1 10/2009 Lourenco et al.
2009/0282863 A1* 11/2009 Lourenco ..... C10L 3/10 62/619
2009/0282865 A1 11/2009 Martinez et al.
2010/0242499 A1 9/2010 Lourenco et al.
2010/0287985 A1 11/2010 Martinez et al.
2011/0036122 A1 2/2011 Betting et al.
2011/0067441 A1* 3/2011 Martinez ..... F25J 3/0209 62/620
2011/0094263 A1 4/2011 Wilding et al.
2011/0174017 A1 7/2011 Victory et al.
2012/0060554 A1 3/2012 Schmidt
2012/0169049 A1 7/2012 Oxner et al.
2012/0255325 A1* 10/2012 Prim ..... F25J 3/0209 62/620
2013/0333416 A1 12/2013 Lourenco et al.
2015/0143842 A1 5/2015 Lourenco et al.

FOREIGN PATENT DOCUMENTS

CA 2 467 338 A1 7/2003
CA 2 516 785 A1 9/2004
CA 2 552 366 A1 7/2005
CA 2 299 695 A1 7/2007
CA 2 536 075 C 7/2007
CA 2 318 802 A1 2/2008
CA 2 728 716 A1 1/2011
CA 2 777 760 A1 5/2011
CA 2 763 081 A1 12/2011
CA 2 515 999 A1 12/2012
CN 1615415 A 5/2005
CN 101948706 A 1/2011

(56) References Cited

FOREIGN PATENT DOCUMENTS

| | | | |
|---|---|---|---|
| DE | 44 16 359 | A1 | 10/1998 |
| EP | 0 482 222 | A1 | 4/1992 |
| EP | 0 566 285 | A1 | 10/1993 |
| EP | 0 635 673 | A1 | 1/1995 |
| EP | 0 780 649 | A1 | 6/1997 |
| FR | 2 420 081 | A1 | 10/1979 |
| GB | 1011453 | | 12/1965 |
| GB | 2 103 354 | A | 2/1983 |
| JP | 3-236589 | A | 10/1991 |
| JP | 5-263998 | A | 10/1993 |
| JP | 2002-295799 | A | 10/2002 |
| JP | 2003-165707 | A | 6/2003 |
| RU | 2 180 420 | C2 | 3/2002 |
| RU | 2 232 342 | C1 | 7/2004 |
| WO | 94/11626 | A1 | 5/1994 |
| WO | 97/01069 | A1 | 1/1997 |
| WO | 98/59205 | A2 | 12/1998 |
| WO | 99/31447 | A3 | 6/1999 |
| WO | 00/52403 | A1 | 9/2000 |
| WO | 03/081038 | A1 | 10/2003 |
| WO | 03/095913 | A1 | 11/2003 |
| WO | 03/095914 | A1 | 11/2003 |
| WO | 2004/010480 | A1 | 1/2004 |
| WO | 2004/052511 | A1 | 6/2004 |
| WO | 2004/109180 | A1 | 12/2004 |
| WO | 2004/109206 | A1 | 12/2004 |
| WO | 2005/045337 | A1 | 5/2005 |
| WO | 2006/004723 | A1 | 1/2006 |
| WO | 2006/019900 | A1 | 2/2006 |
| WO | 2006/036441 | A1 | 4/2006 |
| WO | 2008/006221 | A1 | 1/2008 |
| WO | 2009/061777 | A1 | 5/2009 |
| WO | 2012/015554 | A1 | 2/2012 |
| WO | 2014/032179 | A1 | 3/2014 |

OTHER PUBLICATIONS

Hidnay, A.J., and W.H. Parrish, "Fundamentals of Natural Gas Processing," Taylor & Francis Group, Abingdon, U.K., © 2006, 440 pages.

International Search Report and Written Opinion dated Jul. 18, 2014, issued in corresponding International Application No. PCT/CA2014/050374, filed Apr. 14, 2014, 9 pages.

International Search Report and Written Opinion dated May 1, 2012, issued in corresponding International Application No. PCT/CA2012/050030, filed Jan. 18, 2012, 9 pages.

* cited by examiner

PRIOR ART FIG 1

METHOD TO PRODUCE LNG

FIELD OF THE INVENTION

The present invention relates to a method to liquefy natural gas. The method was developed with straddle plants in mind, but has broader application.

BACKGROUND OF THE INVENTION

Canadian Patent Application 2,763,081 (Lourenco et al) entitled "Method to Product Liquefied Natural Gas (LNG) at Midstream Natural Gas Liquids (NGLs) Recover Plants" describes a process addition to straddle plants which are used to recover natural gas liquids (NGL's). The described process allows these plants, in addition to producing NGL's, to also efficiently produce liquid natural gas (LNG).

There will hereinafter be described an alternative to the method described in the 2,763,081 patent application. The method can be used wherever high pressure gas flows and supporting infrastructure exists to deal with the process streams, such as at straddle plants.

SUMMARY OF THE INVENTION

There is provided a method to produce Liquid Natural Gas (LNG). A first step involves passing a &watered natural gas stream at pressures of between 700 psig and 1200 psig through one or more heat exchangers to pre-cool the natural gas stream. A second step involves passing the pre-cooled natural gas stream through a gas column where natural gas liquid fractions and natural gas fractions are separated. A third step involves passing the natural gas fractions at pressures of between 700 psig and 1200 psig through a gas treatment unit to remove carbon dioxide gas. A fourth step involves passing the de-carbonized natural gas fractions at pressures of between 700 psig and 1200 psig through one or more heat exchangers to pre-cool the de-carbonized natural gas fractions. A fifth step involves passing the de-carbonized natural gas fractions at pressures of between 700 psig and 1200 psig through a gas expansion apparatus where pressure of the de-carbonized natural gas fractions is lowered to a pressure of less than 100 psig. A sixth step involves passing the de-carbonized natural gas fractions at a pressure of less than 100 psig through a separator where the de-carbonized natural gas fractions are separated into an LNG stream and a natural gas stream at a pressure of less than 100 psig.

Where there is a high pressure stream of natural gas (ie at pressures in a range of 700 psig to 1200 psig) that can be tapped, the above method can operate without external power inputs, resulting in substantial savings in both capital and operating costs.

The input temperature of a high pressure stream of natural gas is relatively constant. This means that once steady state is achieved, the ratio of cold gas vapour is constant relative to a flow rate of the natural gas. A high pressure LNG pump can be used to divert a reflux stream from the LNG stream to the gas column in order to maintain desired operating conditions.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DESCRIPTION OF A PRIOR ART STRADDLE PLANT

Figure 1:
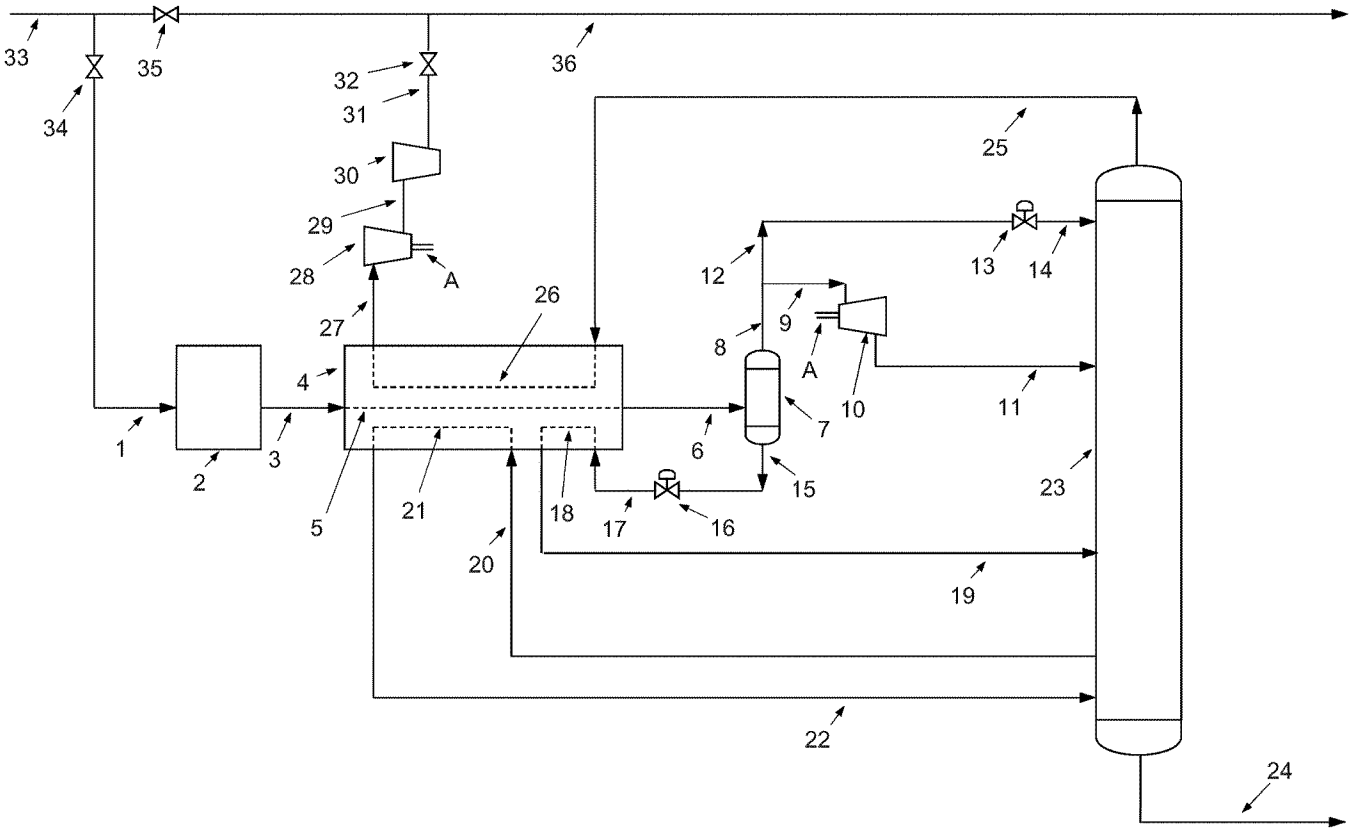
FIG. 1 labelled as PRIOR ART is a schematic diagram of a typical straddle plant equipped with a gas pre-treatment, heat exchangers (cold box), an expander-compressor and a main compressor for re-compression to transmission pipeline.

LNG is produced from a natural gas that has been cooled to a cryogenic condition to condense methane, the natural gas main component, A temperature of approximately −160 C is required to produce and keep natural gas in a liquid state at standard atmospheric pressure. Liquefaction reduces the volume of natural gas by approximately 600 times thus making it more economical to transport over great distances versus traditional pipelines. At present LNG is primarily transported across continents thus making it available throughout the world. LNG is also produced in small scale liquefaction plants to supply peak shaving demands, as well as to make available natural gas to regions that need it but where it is not economical or technically feasible to build pipelines.

The differences in liquefaction selection processes for large versus small LNG plants are; for large plants the main criteria is minimization of capital cost whereas the minimization of energy consumption is left as a second objective. These two objectives can also go together; thus an optimization of the efficiency of the plant may involve a reduction in the investment of the equipment. On the other hand, a higher efficiency can result in an increase in LNG production, so the efficiency factor has a significant impact on the plant economics. In small to medium LNG plants, it is not the efficiency, but other factors such as simplicity, modularization, ease of maintenance, operation and installation that have an higher criteria when selecting a liquefaction technology. The direct consequence of these different selection criteria is that liquefaction technologies for small to medium scale applications are not the same as the ones that are used in large LNG plants.

The two main groups of liquefaction technologies are the mixed refrigerant technologies and expansion based technologies. The mixed refrigerant technologies are "condensing type" processes, where the refrigerant used for the liquefaction makes use of its latent heat of vaporization to cool the natural gas. The expansion based technologies are processes where the refrigerant is always in gas phase and only makes use of its sensible heat to cool the natural gas.

The following mixed refrigerant technologies are the most representative processes in the industry: PRICO (Poly Refrigerated integrated Cycle Operation is licensed by Black and Veatch and it consists of one cycle of mixed refrigerant (a mixture of methane, ethane, propane, butane, nitrogen and sometimes isopentane), the advantages claimed by the licensor are operating flexibility, modular design and reduced refrigerant inventory. The AP-M (Air Products) is licensed by APCI, is a single mixed refrigerant that is vaporized at two different levels of pressure. The dual pressure cycle is more efficient than the single pressure cycle, resulting in smaller heat exchangers and compressor. The LiMuM (Linde Multistage Mixed Refrigerant) is licensed by Linde and consists of a spiral wound heat exchanger and one 3-stage single mixed refrigeration loop for the pre-cooling, liquefaction and sub-cooling of the natural gas. This process allows for high capacity throughput, PCMR (Pre-cooled Mixed Refrigerant) is licensed by Kryopak and consists of a pre-cooling stage (ammonia or propane cycle) followed by a single mixed refrigerant cycle, where the mixed refrigerant is a mixture of nitrogen, methane, ethane, propane and butanes, this process is used primarily in small plants, OSMR (Optimized Single Mixed Refrigerant) is licensed by LNG Limited, the process is a single mixed refrigerant process complemented with a standard package ammonia absorption process. The utilization of an ammonia process improves the efficiency of the process and an increase in LNG output compared to traditional single mixed refrigerant processes. In all of the above mixed refrigerant technologies, the main differences between them are the composition of the mixed refrigerant (although the refrigerants are the same ie; nitrogen, methane, ethane, etc . . . ), the metallurgy of the heat exchangers, the orientation of the equipment and the operations set points. In all the mixed refrigerants processes the objective of innovation is to increase efficiency, reducing capital and operating costs.

The expansion based technologies have various processes based on the use of nitrogen as a refrigerant to liquefy natural gas, the $N_2$ expansion cycle. Some of these processes use a single cycle, others use a dual expansion cycle and in other cases a pre-cooling cycle is added to improve efficiency. Several licensors ie; APCI, Hamworthy, BHP Petroleum Pty, Mustang Engineering and Kanfa Oregon offer the $N_2$ expansion cycles processes, they differ by proprietary process arrangement. In all these processes the cooling is provided by an external refrigeration plant using nitrogen expanders. The Niche LNG process is licensed by CB&I Lummus, consists of two cycles: one cycle uses methane as a refrigerant and the other uses nitrogen. The methane provides cooling at moderate and warm levels while the nitrogen cycle provides refrigeration at the lowest temperature level. The OCX process is licensed by Mustang Engineering and is based on the use of the inlet gas as a refrigerant in an open refrigerant cycle with turbo-expanders, there are variations such as OCX-R which adds a closed loop propane refrigerant to the OCX process and OCX-Angle which incorporates LPG recovery.

As demonstrated, presently there are many variations and processes to liquefy LNG. All of the processes operate based on the expansion of low boiling fluids be it through expanders or JT valves, be it closed or open cycle, the difference between them is in the process efficiencies which result in lower capital and operating costs per unit of LNG produced.

A straddle plant is a natural gas processing plant constructed near a transmission pipeline downstream from the fields where the natural gas in the pipeline has been produced. Also called an "on-line" plant. The straddle plant removes natural gas liquids, the $C_2^+$ gas fractions, from the transmission natural gas stream. This is done by first pre-treating the gas stream, pre-cooling it and then reducing the transmission gas high pressure stream in a range of 700 to 1200 psig, typically about 1000 psig, through a gas expander to pressures typically about 325 psig, to cool, condense and separate the $C_2^+$ gas fractions in a distillation column. The bottoms of the distillation column exit the plant as the recovered natural gas liquids (NGL's). The distillation column overhead stream, primarily $C_2^-$ gas fractions, are pre-heated in a countercurrent heat exchange by the straddle plant pre-treated feed gas stream and re-compressed in two steps back to the same transmission pipeline gas pressure. The major operating cost of these straddle plants are the re-compression costs. The re-compression is typically done in two steps. The first step is done through a booster compressor, which typically is a direct drive compressor connected to the gas expander, the energy recovered by expanding the gas from the transmission gas pipeline high pressure is directly used to compress the distillation gas overhead stream from distillation column pressure to an intermediate gas pressure, typically from 450 to 550 psig. The main re-compressor then compresses this intermediate pressure to transmission pipeline pressure. The economics of a straddle plant are based on the quantities and revenues of natural gas liquids produced against the re-compression and maintenance costs.

Referring to FIG. 1, a pressurized pipeline natural gas stream 33 is routed to a straddle plant through valve 34. Valve 35, allows the transmission gas pipeline to bypass the straddle plant. High pressure gas stream 1 enters the straddle plant and is first pre-treated in unit 2 to remove the water content. The de-watered stream 3 is then routed to cold box 4 where it is pre-cooled in coil 5 by counter current gas streams in series, first by gas coil 21, then gas coil 26 and finally gas coil 18. The high pressure, pre-cooled gas stream 6 enters separator 7 where the liquids and gaseous fractions are separated. The liquid fraction is routed through stream 15 to expansion valve 16, where the pressure is reduced to column 23 pressure, this pressure expansion generates more coolth energy and the now expanded and cooler gas is routed through stream 17 to coil 18 in the cold box, pre-cooling the high pressure gas stream in coil 5. The now warmer stream 19 enters distillation column 23 for NGL recovery. The gaseous fraction exits separator 7, through stream 8 which divides into two streams, 9 and 12. Stream 9 enters expander compressor 10 where the high pressure gas is expanded to column 23 pressure, generating torque in shaft A, which drives booster compressor 28 and, the colder gas stream exits the expander-compressor 10 through stream 11 into column 23 for NGL's recovery. The gaseous stream 12 is routed through expansion valve 13, where the high pressure gas is expanded to column 23 pressure and the cooler expanded gas enters column 23 through stream 14 as a reflux stream to control column 23 overhead temperature and distillation. The recovered NGL's exit column 23 through line 24. The stripped gas exits column 23 through stream 25 and is pre-heated in the cold box through coil 26. The warmer gas stream 27 enters booster compressor 28 which is connected through shaft A to the expander 10, thus recovering the mechanical work produced by the expander and boosting stream 27 pressure to stream 29. The boosted pressure stream 29 enters main compressor 30, where the pressure is increased to transmission pipeline pressure and routed through stream 31, through straddle plant block valve 32 and into pipeline gas distribution stream 36.

The above described process in FIG. 1 is the operation of a traditional straddle plant, there are various straddle plant modes of operation to improve the recovery of the NGL's, in all cases the objective is to produce NGL's.

Figure 2:
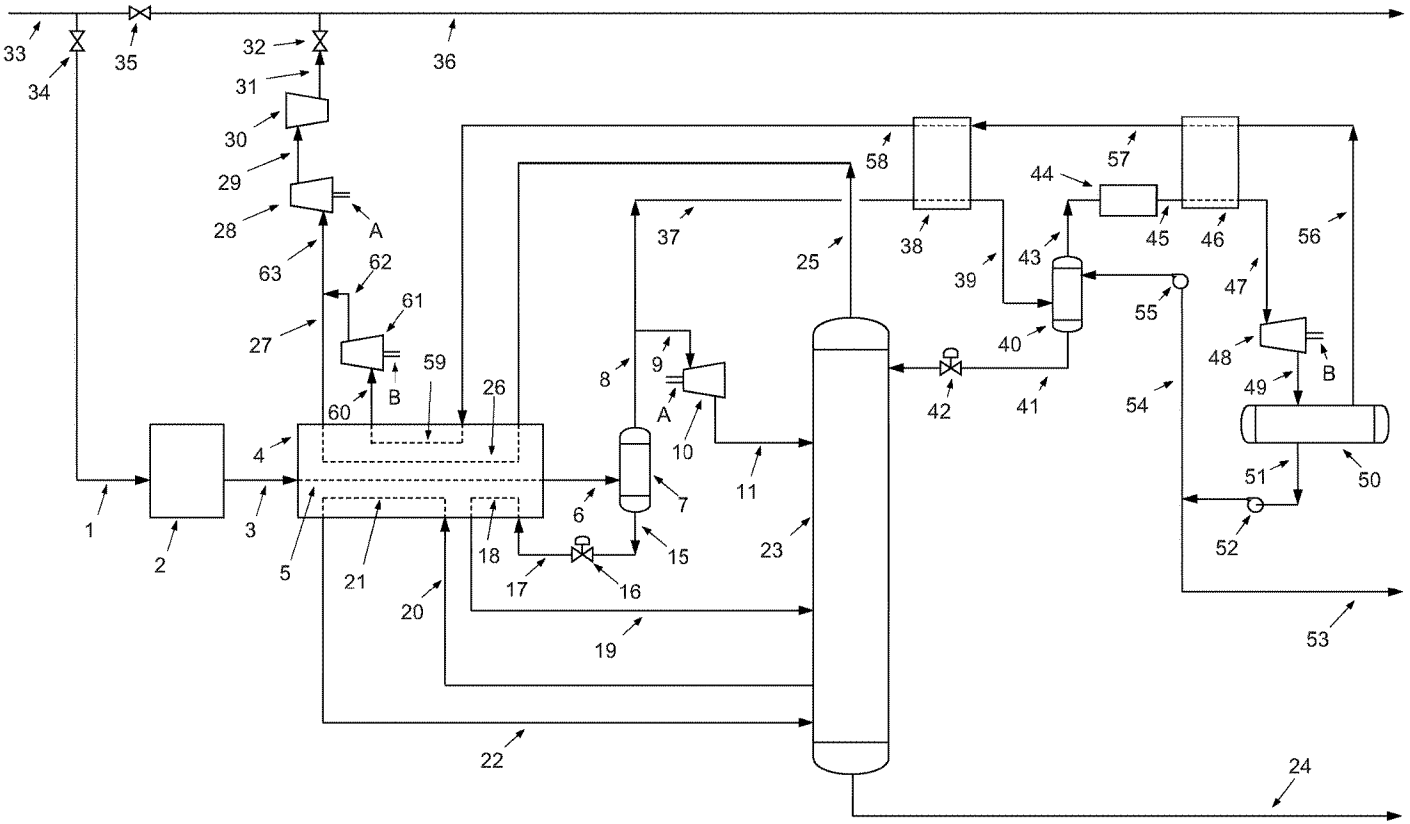
FIG. 2 is a schematic diagram of a typical straddle pant with the addition of a LNG production unit facility equipped with an alternate cooling, processing and treating medium and compression of the recycled vapour fraction.

Referring to FIG. 2, the difference from FIG. 1, is the addition of a LNG production section to a conventional straddle plant which as described above its main objective is to produce NGL's. A pressurized pipeline natural gas stream 33 is routed to a straddle plant through valve 34. Valve 35, allows the transmission gas pipeline to bypass the straddle plant. High pressure gas stream 1 enters the straddle plant and is first pre-treated in unit 2 to remove the water content. The de-watered stream 3 is then routed to cold box 4 where it is pre-cooled in coil 5 by counter current gas streams in series, first by gas coil 21, then gas coil 59, gas coil 26 and finally gas coil 18. The high pressure, pre-cooled gas stream 6 enters separator 7 where the liquids and gaseous fractions are separated. The liquid fraction is routed through stream 15 to expansion valve 16, where the pressure is reduced to column 23 pressure, this pressure expansion generates more coolth and the now expanded and cooler gas is routed through stream 17 to coil 18 in the cold box, pre-cooling the high pressure gas stream in coil 5. The now warmer stream 19 enters distillation column 23 for NGL recovery. The gaseous fraction exits separator 7, through stream 8 which divides into two streams, 9 and 37. Stream 9 enters expander-compressor 10 where the high pressure gas is expanded to column 23 pressure, generating torque in shaft A, which drives booster compressor 28 and, the colder gas stream exits expander-compressor 10 through stream 11 into column 23 for NGL's recovery. The recovered NGL's exit column 23 through line 24. The stripped gas exits column 23 through stream 25 and is pre-heated in the cold box through coil 26. The warmer gas stream 27 mixes with LNG plant section gas stream 62 before entering booster compressor 28. The high pressure gaseous stream 37 is the LNG section feed stream, it is routed through heat exchanger 38 where it is further cooled, the colder stream 39 enters column 40 where the methane concentration of stream 43 is controlled. The high pressure liquid fraction 41 is expanded through valve 42 to distillation column 23 pressure as a reflux stream to control distillation column overhead temperature of stream 25. The methane content controlled stream 43 is routed to gas treatment unit 44 to remove the carbon dioxide content in this stream to less than 50 ppm. The de-carbonated stream 45 enters heat exchanger 46 where it is further cooled by gaseous cold stream 56. The high pressure, de-carbonated, and further cooled stream 47 enters expander-compressor 48, where it is expanded to pressures from 0-100 psig, with 10 psig being the preferred operating pressure, the expanded stream 49 enters separator 50, where the liquid fraction LNG is separated from the gaseous fraction. The torque enemy generated by expander 48 is recovered and transferred by shaft B to booster compressor 61 shaft B.

The LNG stream 51 enters LNG pump 52 and is split into streams 53 and 54. LNG stream 53 is routed to storage. LNG stream 54 is routed to high pressure pump 55 where the pressure is increased to column 40 pressure, the LNG flowrate is added to control column overhead temperature, stream 43 and hence the concentration of methane to 85% or greater than 85% by mole. The cold gaseous stream 56 exits separator 50 and is routed to heat exchanger 46, the warmer gaseous stream 57 is further heated in heat exchanger 38, exiting it through stream 58 into cold box coil 59 where it is further heated before entering booster compressor 61 through line 60. Compressor 61 is powered by torque energy recovered in expander 48 through shaft B. The boosted pressure gaseous stream 62 mixes with stream 27 and the mixed stream 63 enters booster compressor 28 where the pressure is further boosted to stream 29. Compressor 28 is powered by torque energy recovered in expander 10 through shaft A. Stream 29 gas enters main compressor 30 where the pressure is increased to transmission pipeline pressure 36, exiting the compressor through stream 31 and straddle plant block valve 32.

The proposed invention addresses both large and small plants in which process simplicity and ease of operation are the main components. The invention eliminates the need for refrigeration cycle plants and the use of proprietary mixed refrigerants. By simplifying the process it reduces capital, maintenance and operations costs. In the preferred method, a pre-treated, pre-cooled high pressure natural gas stream is further cooled in a counter-current second heat exchanger with produced cold LNG vapor, treated, to a methane content specification, then de-carbonated, further cooled in a primary heat exchanger and then expanded through a gas expander. The gas expander produces torque and therefore shaft power that can be converted into mechanical compression power or electricity. In the preferred application the shaft power is used for compression. The expanded gas produces a gaseous and a liquid stream. The gaseous stream is routed to the transmission pipeline first by pre-heating it with inlet feed gas stream and then recompressed to the transmission gas pipeline. The liquid stream, LNG is split into two streams, LNG to storage and LNG for a column reflux. The LNG reflux stream is pressurized to column pressure to control the methane content of the LNG production stream. The bottoms of the column are then sent to the distillation column for the recovery of NGL's. The objective of the invention is to provide the ability for a straddle plant to improve its economics by generating LNG in addition to NGL's. In addition, the ratio of NGL's produced in this mode of operation to gas from the straddle plant to gas transmission pipeline is increased.

A main feature of this invention is the simplicity of the process which eliminates the conventional use of external refrigeration systems for LNG production. Another feature of the invention is the flexibility of the process to meet various operating conditions since the ratio of LNG production is proportional to the cold gaseous stream generated and returned to the transmission gas pipeline. The invention also provides for a significant savings in energy when compared to other LNG processes since the process produces its own refrigeration needs. The proposed invention can be used in any straddle plant size.

Variations:

It should be noted that the motive force generated by the expanders can be connected to a power generator to produce electricity versus a connected gas compressor as proposed.

Figure 3:
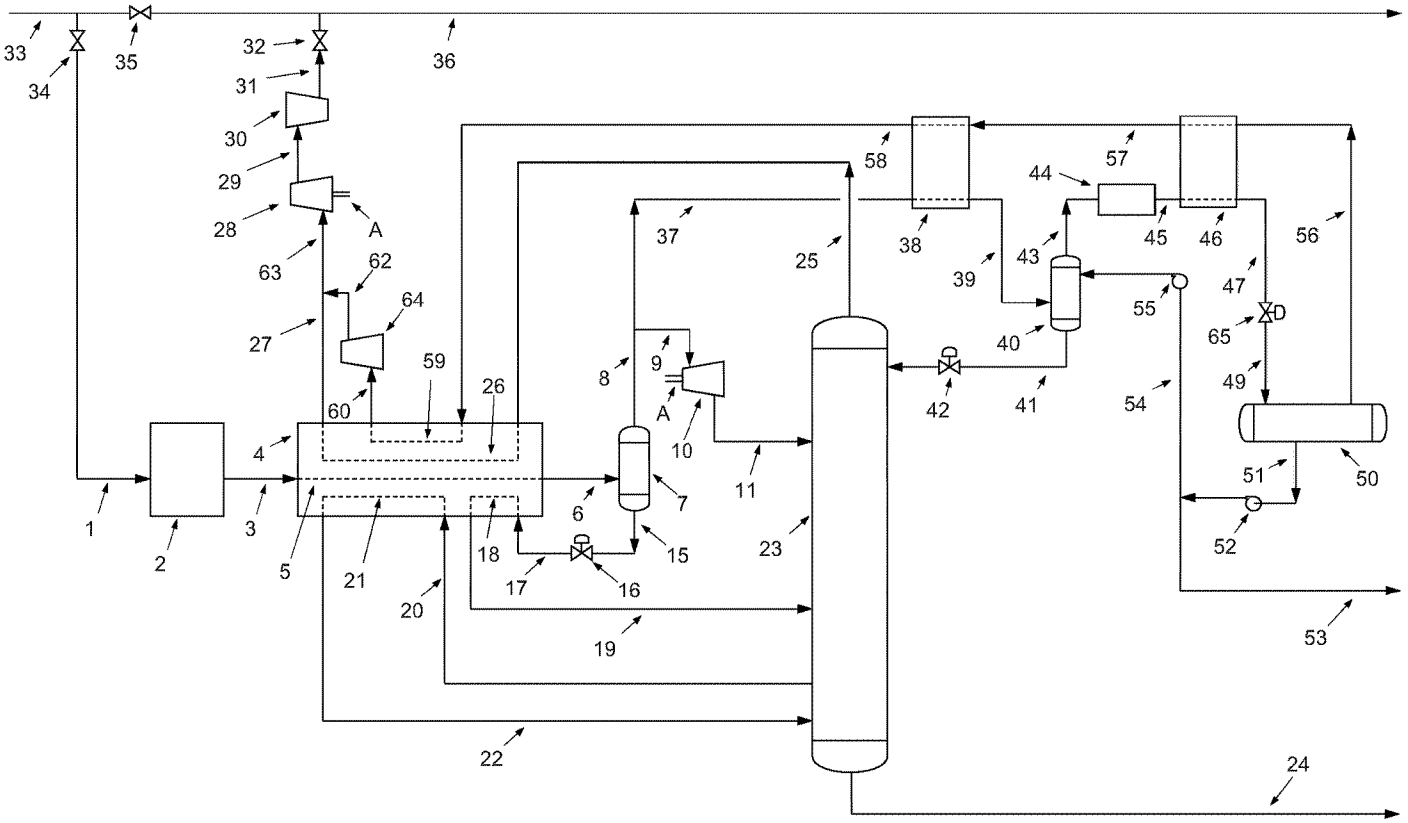
FIG. 3 is a schematic diagram of a typical straddle pant with the addition of a LNG production unit facility equipped with A JT (Joules Thompson) valve in lieu of a gas expander.

Referring to FIG. 3, the main difference from FIGS. 2 and 3, is the use of a JT expansion valve 65 in lieu of an expander-compressor. The use of a JT valve versus an expander is an alternative mode of LNG production at a lower capital cost but resulting in a lower production of LNG.

Figure 4:
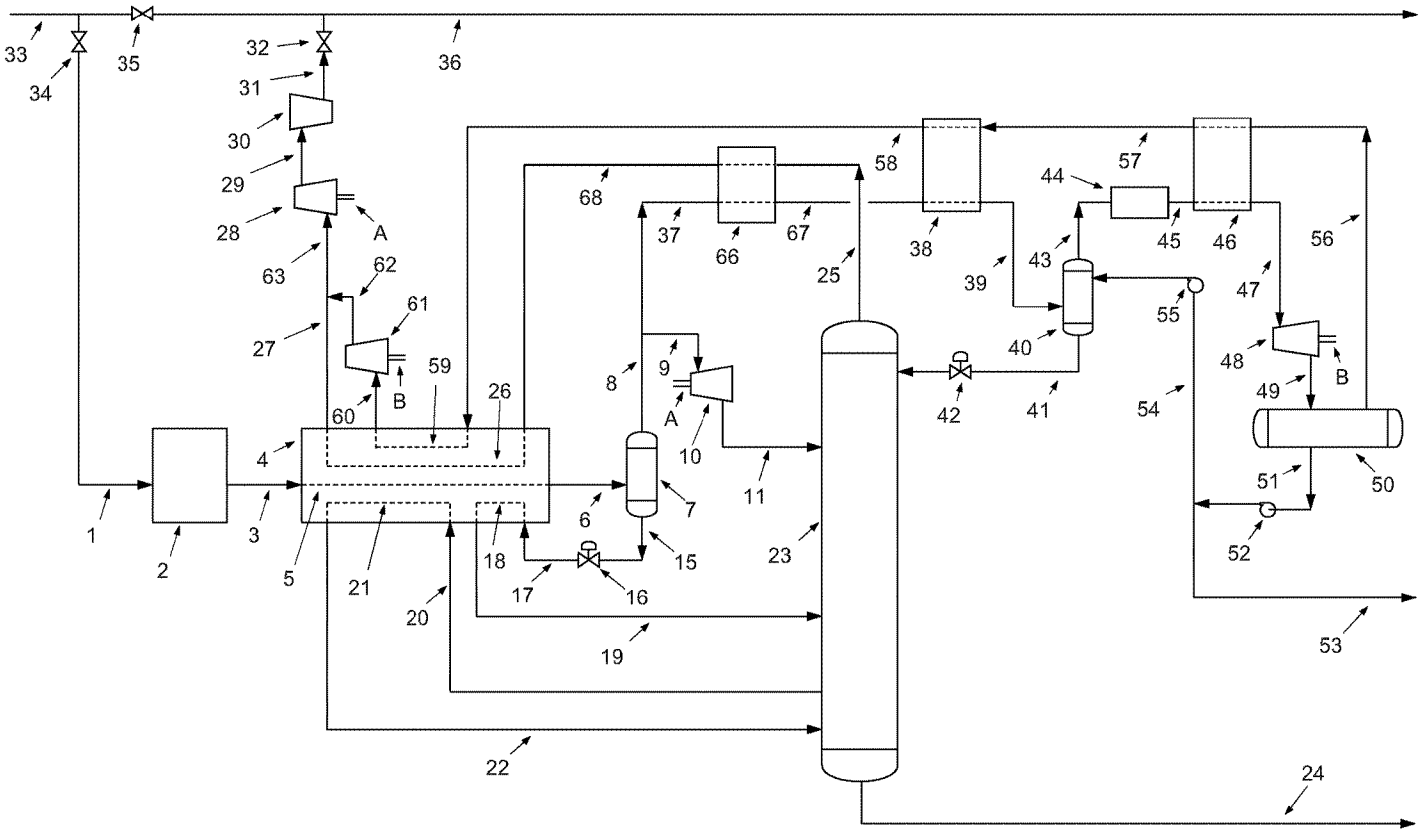
FIG. 4 is a schematic diagram of a typical straddle pant with the addition of a LNG production unit facility equipped with an additional heat exchanger to extract more cooling from the straddle plant and improve LNG production.

Referring to FIG. 4, the main difference from FIGS. 2, 3, and 4 is the addition of a heat exchanger 66, where stream 37 recovers more coolth energy from stream 25, before being further cooled by the in heat exchanger 38. This added feature allows for an increment in LNG production due to an higher recovery of cryogenic energy versus FIG. 2.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the preferred embodiments set forth in the examples, but should be given a broad purposive interpretation consistent with the description as a whole.

What is claimed is:

1. A method to produce liquid natural gas (LNG) using an LNG plant feed stream, the LNG plant feed stream comprising a high pressure, pre-treated, pre-cooled natural gas stream from a straddle plant, the method comprising:

cooling the LNG plant feed stream in at least one heat exchanger;

removing natural gas liquids (NGLs) from the cooled LNG plant feed stream using a gas column downstream of the at least one heat exchanger;

removing carbon dioxide gas from a vapor stream of the gas column using a gas treatment unit downstream of the gas column;

cooling the vapor stream using one or more heat exchangers downstream of the gas treatment unit to produce a cooled de-carbonated stream;

expanding the cooled de-carbonated stream in a gas expansion apparatus;

providing an LNG separator downstream of the gas expansion apparatus to separate the expanded cooled de-carbonated stream into an LNG stream and a natural gas stream; and providing a high pressure LNG pump for pumping a portion of the LNG stream to the gas column of the straddle plant as a reflux stream.

2. The method of claim 1, wherein the gas expansion apparatus is a JT valve or a gas expander turbine.

3. The method of claim 1, wherein cooling in one or more heat exchangers is provided by the natural gas stream from the LNG separator.

4. The method of claim 1, wherein the reflux stream to the gas column controls a methane concentration of an overhead stream of the gas column.

5. The method of claim 1, wherein the gas column produces a bottoms stream that is routed to the gas column as a gas column reflux and for NGL recovery.

6. The method of claim 1, wherein the gas treatment unit removes the carbon dioxide gas in an overhead stream of the gas column to a concentration of less than 50 ppm.

7. The method of claim 1, wherein the vapor stream downstream of the gas treatment unit is cooled by the natural gas stream from the LNG separator before entering the gas expansion apparatus.

8. The method of claim 2, wherein the gas column produces a bottoms stream that is a mixture of NGLs from the LNG plant feed stream, carbon dioxide and methane.

9. The method of claim 1, further comprising a straddle plant feed gas stream that feeds a distillation column, and wherein the LNG plant feed stream is obtained by diverting a portion of the straddle plant feed gas stream upstream of the distillation column.

10. The method of claim 9, wherein the NGLs from the gas column are expanded and injected into the distillation column as a distillation column reflux stream.

* * * * *